United States Patent [19]

Torralba

[11] 4,096,722

[45] Jun. 27, 1978

[54] ROLL-TYPE THREAD CUTTING DIE

[76] Inventor: Jose Estaban Torralba, Miguel Servet, 216, Zaragoza, Spain

[21] Appl. No.: 708,563

[22] Filed: Jul. 26, 1976

[30] Foreign Application Priority Data

Jul. 31, 1975 Spain ..... 214.356

[51] Int. Cl.[2] ..... B21H 3/04

[52] U.S. Cl. ..... 72/104; 72/121; 10/152 R

[58] Field of Search ..... 72/104, 121, 123; 10/103, 121, 123, 152; 74/571; 308/62

[56] References Cited

U.S. PATENT DOCUMENTS

| | | | |
|---|---|---|---|
| 1,549,845 | 8/1925 | Munz | 308/62 |
| 1,571,557 | 2/1926 | Paul | 308/62 |
| 2,541,573 | 2/1951 | Conner | 74/571 R |
| 2,720,801 | 10/1955 | Erdelyi et al. | 10/94 |
| 3,353,390 | 11/1967 | Bedker | 72/104 |

*Primary Examiner*—Lowell A. Larson
*Attorney, Agent, or Firm*—Ostrolenk, Faber, Gerb & Soffen

[57] ABSTRACT

A roll-type thread cutting die capable of cutting threads in shafts of varying diameters is disclosed. A plurality of threaded rollers are rotatably mounted on the smooth end portion of a plurality of bolts, each bolt having an intermediate main body portion, a smooth end portion and a grooved end portion. The main body portion of each of the plurality of bolts is supported by a different circumferentially spaced bore in a support plate having an axial bore capable of accommodating a shank on which threads are to be cut. Each of the plurality of circumferentially spaced bores is positioned a distance from the axial bore sufficient to enable the threads of its associated roller to contact the shank on which the threads are to be cut. A positioning plate having a plurality of grooved bores adapted to engage the grooved end portions of the bolts is positioned adjacent to the support plate and holds the bolts in a preselected angular orientation. The angular orientation of the bolts determines the distance the threads of each roller extend toward the axis of the axial bore thereby enabling the die to accommodate shanks of various diameters.

5 Claims, 4 Drawing Figures

ROLL-TYPE THREAD CUTTING DIE

The present invention relates to die cutting apparatus, more particularly roll-type thread cutting dies. Roll-type thread cutting dies are much more desirable than conventional apparatus based on chip removal which is a slower, more wasteful and less accurate process.

Since roll-type thread cutting dies deform rather than remove parts of the work piece, threads formed by rolling are much smoother than threads formed by chip removal. Additionally, since there are no tangential forces applied to the threads during the forming process, the danger of chipping away the ends of the threads is minimized and more precise work may be performed.

In addition to the foregoing advantage over devices based on chip removal, the present invention represents a significant improvement over prior art roll-type thread cutting dies. As a result of the unique structure of the present invention, a single cutting die may be adapted to accommodate shafts of different diameters by merely adjusting the orientation of a plurality of cylindrical bolts on which the threaded rollers are rotatably supported. The novel construction of the present invention further represents a distinct improvement over the prior art by providing a structure which permits quick and simple replacement of rollers when the old rollers have worn out.

The present invention includes a support member which is preferably cylindrical and hollow and which has a central bore coaxial therewith. The diameter of the bore is sufficient to accommodate the maximum diameter of shanks on which screw-threads are to be cut. The support member is also provided with three machined bores adapted to receive bolts carrying threaded rollers and arranged eccentrically of the axis of the support member.

The axis of each bore is situated equidistant from the axis of the support member. The support member also carries other bores which are screw-threaded to receive screws for anchoring and securing a cover member and a positioning plate which are component elements of the present construction.

The cover member partially covers said rollers and comprises a thick plate provided with a circular hole coaxial therewith and three lugs which support the cover member a sufficient distance above the support member to accommodate the rollers. The cover member is also provided with three holes through which pass the fixing screws.

The said bolts include an intermediate zone and two end zones. One of the end zones is of less diameter than and eccentric with respect to the intermediate zone and serves as a spindle on which the rollers which are provided with a central bore revolve. The remaining end zone of each bolt is grooved and coaxial with the intermediate zone and is adapted to fit into one of three corresponding groove holes provided in the positioning plate. The intermediate zones of the bolts are inserted into one of three corresponding holes in the support member, and locked into position by the engagement of the grooved ends of the bolt and the corresponding grooved bores in the positioning plate.

Due to the eccentricity of the end zones carrying the rollers with respect to the intermittent zones of the bolts, the cutting die of the present invention may be simply and quickly adjusted to accommodate various work pieces of diversed diameters. This may be accomplished by simply removing the positioning plate and rotating the bolts until the rollers extend a sufficient distance towards the central axis of the support member (and therefore the work piece) to accommodate the new work piece. Once the desired location of the rollers is attained, it is maintained by merely replacing the positioning plate and permitting the grooved bores in the plate to engage the grooved zones of the bolts thereby locking the bolts in the desired angular orientation.

For greater clarity and in order to facilitate the understanding of the invention, the accompanying drawing illustrates one embodiment of the invention which is shown by way of example, its purpose being purely explanatory and imposing no limitation on the possible variations with may fall within the scope of the claims.

The structural details of the present invention will be explained hereinafter with the aid of reference numerals employed to identify the parts and component elements of the invention in the ensuing description with reference to the drawing in which.

DETAIL DESCRIPTION OF THE PREFERRED EMBODIMENT

Figure 1:
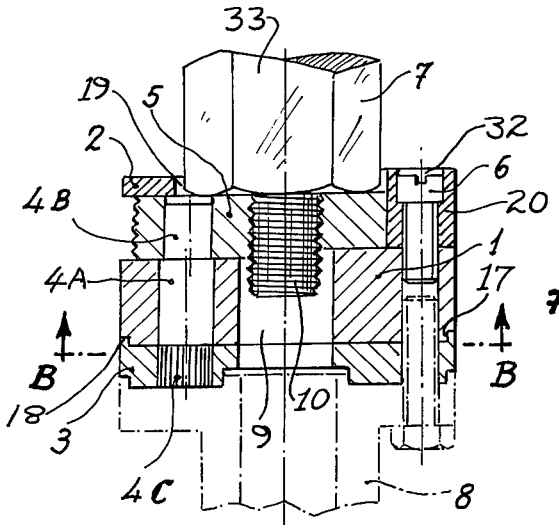
FIG. 1 is a vertical section through a die for roll-type thread cutting, constructed in accordance with the invention, taken on the line A—A in FIG. 2, the Figure showing the end of a work-piece in the process of thread cutting and also showing a die carrying element (indicated by broken lines in the drawing)
Figure 2:
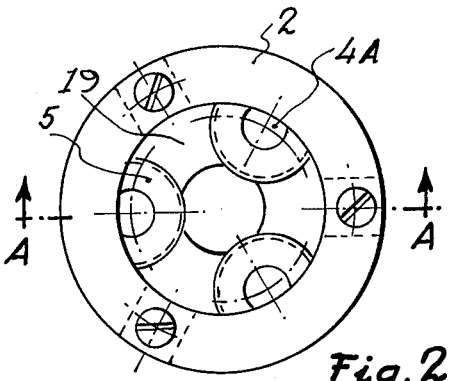
FIG. 2 is a plan view of the die.
Figure 3:
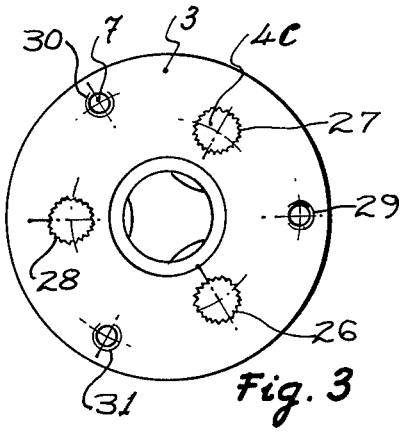
FIG. 3 is a cross-section taken on the line B—B in FIG. 1.
Figure 4:
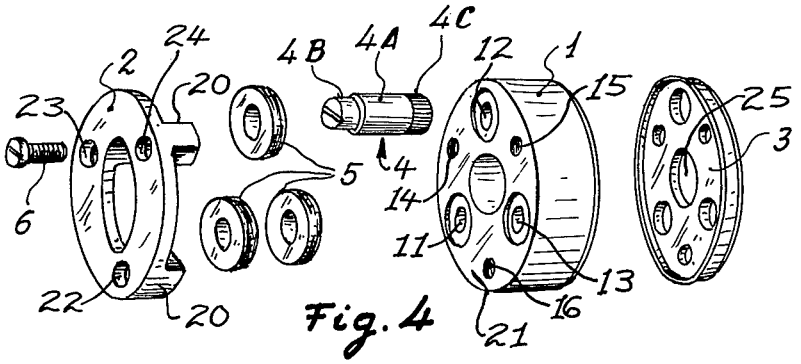
FIG. 4 is a longitudinal exploded view showing the parts of the die.

In accordance with the foregoing and as will be understood from the drawing, a die for cutting a screw thread by means of a rolling process consists of an assembly comprising a support member 1, a cover piece 2, a positioning plate 3, bolts 4, rolls 5 and securing screws 6 by which the assembly of component elements which has just been detailed is secured together.

Support member 1 is centrally bored at 9 for the passage of the work piece 7, the diameter of central bore 9 being slightly greater than the maximum size of the shank 10 of the work pieces in which threads are to be cut. In addition, the support member 1 has three bores 11, 12, 13 coinciding with the vertices of a triangle, into which are fitted the intermediate zones 4A of the bolts 4 as well as other screw-threaded bores 14, 15, and 16 engaged by the securing and fixing screws 6.

A step 17 along the outer lateral face on the lower part of the periphery of support member 1 is engaged by a mating flange 18 along the edge of positioning plate 3 to insure proper alignment of the two members.

The cover piece 2 is provided with a circular aperture 19 of sufficient size to allow the passage of a bar or work piece of maximum diameter into the shank of which the screw thread is to be cut. Cover piece 2 is provided on its underside with extension pieces by which it is supported above on the periphery of the upper face 21 of the support member 1, said extension pieces establishing the necessary space for the rollers 5. The cover piece 2 also has through-bores 22, 23 and 24 for the passage of the screws 6.

The positioning plate 3 is of a shape conforming to that of the support member 1 and is provided with a central orifice 25 of the same diameter as the bore 9 in support member 1. Positioning plate 3 is also provided with grooved orifices 26, 27, and 28 in which engage the grooved zones 4C of the bolts 4. Finally, positioning plate 3 is provided with orifices 29, 30, and 31 through which pass the fixing screws 6.

The bolts 4, each of which, as stated previously, has three zones, a central zone 4A and two zones located at the ends of the zone 4A, one zone 4B being smooth and eccentric with respect to the zone 4A and the other zone 4C being coaxial with the zone 4A and grooved, make it possible to adjust the thread cutting tools 5 which are rollers projecting inwardly with respect to the periphery of the circular aperture 19 in the cover piece 2, the variable positioning of rollers 5 is achieved within predetermined limits by virtue of zone 4B of each bolt 4 which is eccentric with respect to zone 4C. By rotating bolts 5 to a desired angular orientation, it is possible to move rollers 5 toward or away from shank 10 thereby permitting the cutting die to accommodate work pieces of various diameters. Grooves on zones 4C of bolts 4 make it possible to fix the position of the bolt by introducing the zones 4C into the internally grooved holes 26, 28 in the plate 3.

The mounting of the rollers 5 on the smooth zones 4B of bolts 4 permits easy location of the tool in order to produce a right-hand or left-hand screw thread, being provided with parallel grooving, of the profile and pitch of the thread which is to be produced. As may be seen in FIG. 1 of the accompanying drawing, only the rollers in question rotate zone 4B of the bolts 4 are rigidly fixed in the support member 1, such that they are completely free of any oscillatory movement.

The anchoring screws 6 secure the top portion of the assembly, their heads fitting into recesses 32 in the upper face of cover plate 2. A similar set of screws, aligned with screw 6, use identical apertures located at the vertices of another triangle alternating with the aforesaid in order not to weaken the pieces, establish a connection between support member 1, plate 3 and die support 8.

Without prejudice to the foregoing and by way of clarification of the aforesaid concepts, FIG. 1 of the accompanying drawing shows that the axis of the zone 4B of each bolt is a little off center with respect to the axis of its base portion (in this example, two-and-a-half tenths of a millimeter), this offset being utilised to achieve a variation in the dimension of the screw thread simply by rotating the zone 4C and inserting it into a grooved hole in the plate 3. In order to be able to locate and dispose all the bolts 4 in one and the same working situation, the base portions thereof, which can be seen through said holes in the plate 3, have uniformly spaced radial markings which, in conjunction with matching markings provided on the outer face of said plate, make it possible easily to achieve the same working position selected for the three bolts 4 and rollers 5.

In FIG. 1 there is shown a hexagonal bar 7, the lower end of which, prepared as a shank 10, is subjected to a process of thread cutting by rolling. FIG. 1 demonstrates that it is possible to prepare the shank in such a way as to obtain screw-threaded members with a head 33 of large size.

Finally, it will be understood that it is simply sufficient to remove the screws 6 in order to be able to remove all or any one of the rollers 5 for the purpose of replacement, attention or cleaning. Likewise, upon withdrawing the lower bolts, it is possible to check or vary the position of the bolts 4 and to dismantle the die from the carrier element 8.

In accordance with the foregoing description, in the practical embodiment which has been described, it will be understood that among the main advantages which this new rolling type thread cutting die represents, are the easy exchange of the rollers, the possibility of graduating the work and the possibility of extending the thread as far as the actual head in work pieces which have a head of large size.

What I claim is:

1. A roll-type thread cutting die comprising:

at least three selectively rotatable members, each said selectively rotatable member having an end portion extending from one end of and being eccentric with respect to the axis of rotation of its associated selectively rotatable member; and each said rotatable member having a supported portion that is spaced away from said end portion;

a plurality of rollers, one said roller for each said selectively rotatable member, each said roller being rotatably mounted on said end portion of a different one of said selectively rotatable members, each said roller having an external periphery which is threaded, the threads of each said roller extending radially outward from its associated selectively rotatable member;

support means for supporting each of said selectively rotatable members at said supported portions thereof and for leaving said end portions unsupported and unengaged by said support means; said support means positioning each of said selectively rotatable members such that the axis of rotation of each said selectively rotatable member lies along a different axis spaced from and parallel to a central axis; and said support means including means for retaining each of said at least three selectively rotatable members at preselected angular orientations whereby said threads of said plurality of rollers may be adjusted to extend a preselected distance towards said central axis such that said rollers alone cooperate to position a shaft to be threaded along said central axis as said rollers thread said shaft;

a cover piece positioned above said rotatable member end portions and positioned to prevent said rollers from leaving said rotatable member end portions; said cover piece having a central opening therethrough of a diameter greater than the diameter of a circle defined by the axes of rotation of said selectively rotatable members, whereby a large head on a narrower shank to be threaded may be received in said central opening; said cover being attached to said support means.

2. A roll-type thread cutting die as claimed in claim 1 wherein said supported portion of each said selectively rotatable member comprises:

a second end portion extending from said selectively rotatable member; each of said second end portions having a grooved external periphery; and said means for retaining said selectively rotatable members at a preselected angular orientation comprises:

a positioning plate having a plurality of apertures therein equal in number and spacing to the number and spacing of said selectively rotatable members, the walls of said positioning plate surrounding said apertures being grooved and adapted to engage said grooved end portion of a different one of said selectively rotatable members to prevent rotational movement of said selectively rotatable members when said grooved external periphery of said grooved end portion of said selectively rotatable members are placed in operational engagement with said grooved walls of said positioning plate surrounding said apertures.

3. A roll-type thread cutting die as claimed in claim 2 including markings on said positioning plate to facilitate positioning of said selectively rotatable members at desired angular orientations.

4. A roll-type thread cutting die as claimed in claim 1 wherein said support means comprises a cylindrical support plate having bores therein equal in number to the number of said selectively rotatable members, the shape of the walls of said support plate surrounding each said bore being adapted to firmly support a different one of said plurality of selectively rotatable members.

5. A roll-type thread cutting die as claimed in claim 4 wherein said supported portion of each said selectively rotatable member comprises:

a second end portion extending from said selectively rotatable member; said second end portion of each said selectively rotatable member having a grooved external periphery; and said means for retaining said selectively rotatable members at preselected angular orientations comprises:

a positioning plate having a plurality of apertures therein equal in number and spacing to the number and spacing of said selectively rotatable members, the walls of said positioning plate surrounding said apertures being grooved and adapted to engage said grooved end portion of a different one of said selectively rotatable members to prevent rotational movement of said selectively rotatable member when said grooved external periphery of said grooved end portion of said selectively rotatable members are placed in operational engagement with said grooved inner walls of said positioning plate surrounding said apertures.

* * * * *